United States Patent [19]

Silbernagel

[11] Patent Number: 4,618,207

[45] Date of Patent: Oct. 21, 1986

[54] TWO PIECE MODULAR RECEPTACLE

[75] Inventor: Raymond A. Silbernagel, Naperville, Ill.

[73] Assignee: Molex Incorporated, Lisle, Ill.

[21] Appl. No.: 741,512

[22] Filed: Jun. 5, 1985

[51] Int. Cl.[4] ..... H01R 13/506

[52] U.S. Cl. ..... 339/176 M; 29/876; 339/206 R; 339/218 M

[58] Field of Search ..... 29/876; 339/176 M, 206 R, 339/206 P, 17 C, 17 LC, 126 R, 125 R, 218 R, 218 M

[56] References Cited

U.S. PATENT DOCUMENTS

| | | | |
|---|---|---|---|
| 3,315,218 | 4/1967 | Aker | 339/218 R |
| 4,202,593 | 5/1980 | Abernethy et al. | 339/176 M |
| 4,261,633 | 4/1981 | Abernethy | 339/126 R |
| 4,274,691 | 6/1981 | Abernethy et al. | 339/206 R |
| 4,292,736 | 10/1981 | Hughes et al. | 29/884 |
| 4,315,664 | 2/1982 | Hughes et al. | 339/176 M |
| 4,327,958 | 5/1982 | Hughes et al. | 339/276 SF |
| 4,444,451 | 4/1984 | Myers | 339/176 M |

*Primary Examiner*—John McQuade
*Attorney, Agent, or Firm*—Louis A. Hecht

[57] ABSTRACT

An improved two-piece modular phone jack assembly and method of making the same. The jack assembly includes a connector housing and a carrier subassembly mounted in the housing. The carrier subassembly has a support member which mounts a plurality of stamped metallic elongated conductors. The support member includes a body portion, a generally horizontal base portion extending rearwardly of the body portion and a generally horizontal cantilevered top portion extending forwardly of the body portion. The conductors are positioned and stacked onto the upper surface of the top portion of the support member so that simultaneous forming of said conductors can occur during the manufacturing process.

12 Claims, 9 Drawing Figures

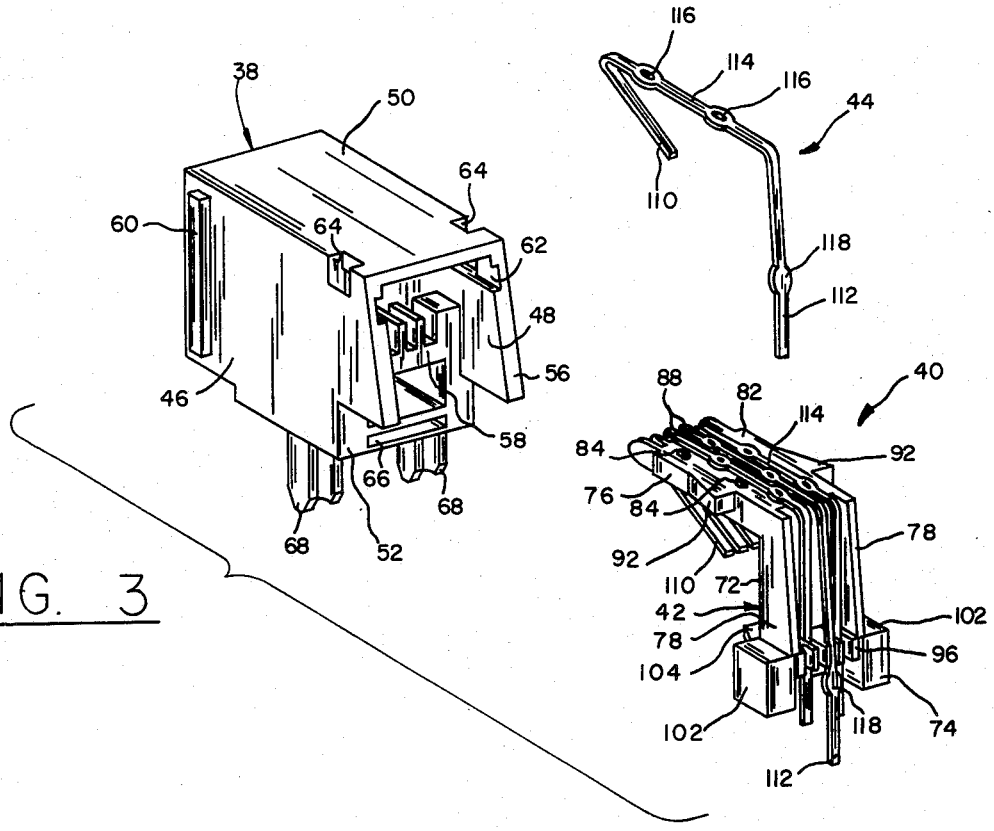
FIG. 3
FIG. 4
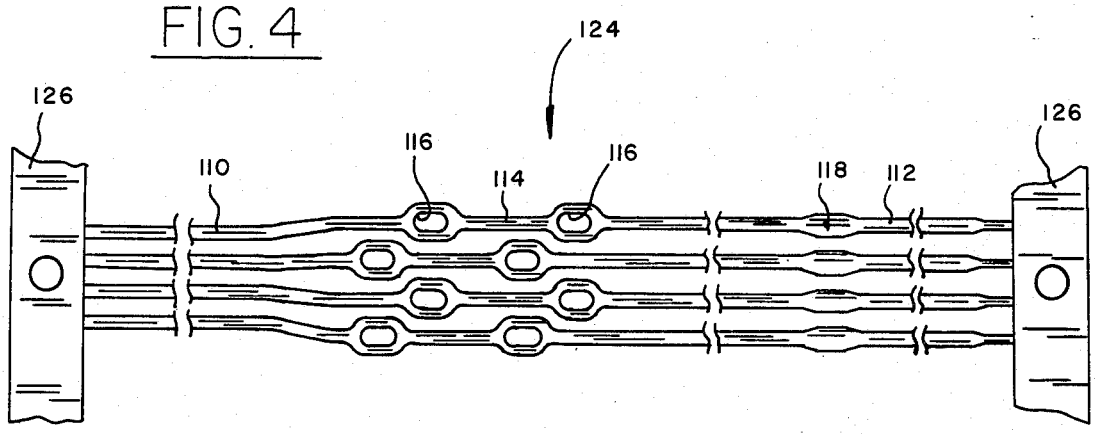

FIG. 5
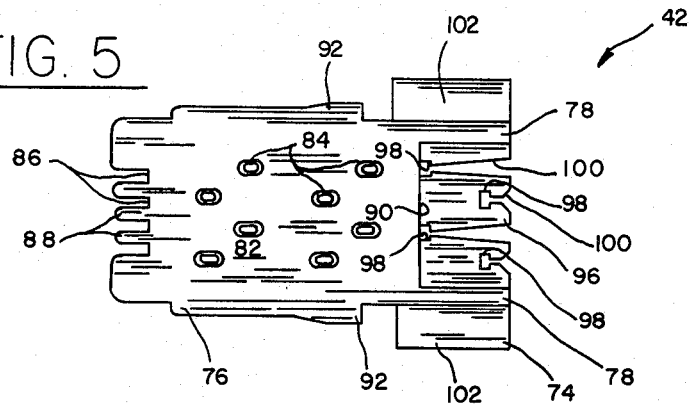
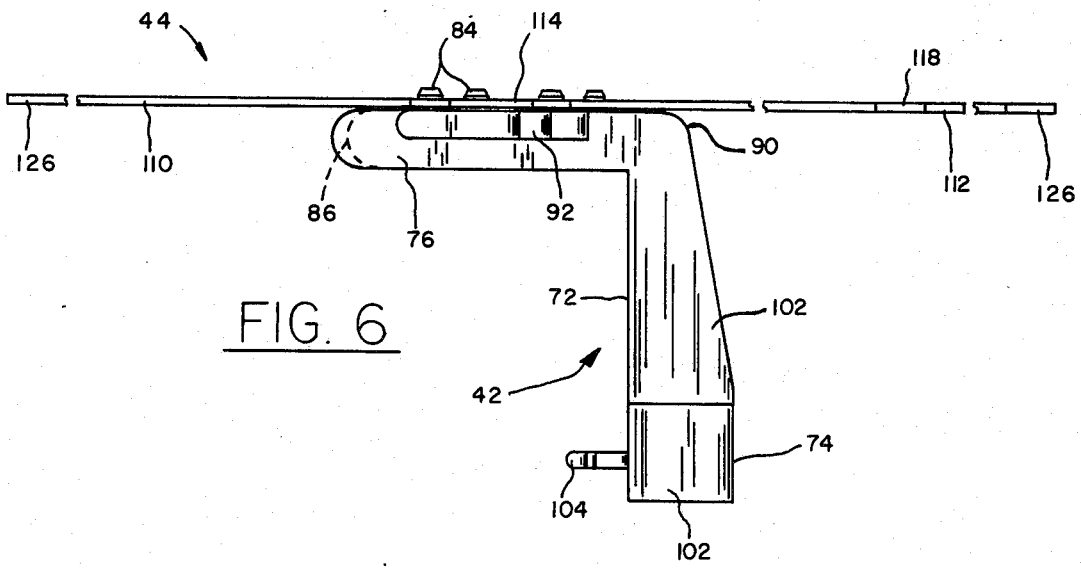
FIG. 6
FIG. 7
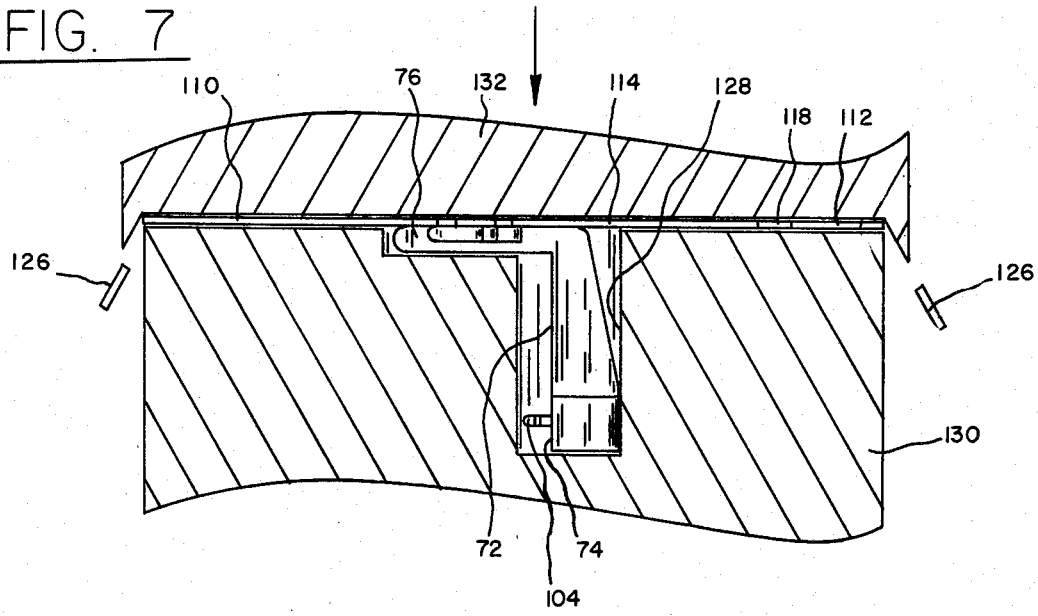

TWO PIECE MODULAR RECEPTACLE

BACKGROUND OF THE INVENTION

1. Field of the Invention

The present invention relates to modular electrical connectors and, in particular, connectors commonly referred to as modular phone receptacles or jacks. The present invention also relates to method of making a modular phone receptacle.

2. Brief Description of the Prior Art

Modular electrical connectors known as modular phone receptacles or jacks have been known in the art for many years. Although connectors of this type were originally designed in the telecommunications industry and, in particular, for telephones, these connectors have found wide acceptance other than for connecting a telephone to a telephone network. Another common use include an input/output (I/O) interface with other communications peripheral equipment.

Modular phone jacks are adapted to receive a conventional modular plug. Thus, the jack has a housing with a plug-receiving socket formed therein to receive the plug. The socket is defined by a plug-receiving opening, opposed top and bottom surfaces joined by opposed side surfaces extending from said opening to join a back surface.

A plurality of stamped, metallic elongated conductors are mounted to the housing in some fashion. Each conductor includes a contact portion at one end extending diagonally into the socket, a lead portion at the other end and an intermediate portion between said contact portion and lead portion.

It is advantageous to form the metallic conductors from flat stock. In this manner a plurality of conductors can be stamped at one time. Two examples of modular phone jacks employing flat stamped metallic conductors are disclosed in U.S. Pat. Nos. 4,292,736 and 4,315,664. Both of these patents disclose a one-piece electric housing having a channels formed in the external surfaces thereof. The channels serve to locate and hold the flat stamped conductors therein.

U.S. Pat. No. 4,292,736 discloses a method of producing a one-piece modular phone jack. The method generally comprises:

producing the housing as a one-piece molded part, manufacturing the conductors as a continuous flat metal strip having a carrier strip with spaced-apart groups of conductors extending in side-by-side co-planar relationship, each group containing the number of conductors required for one of said jack assemblies, positioning the housing adjacent one of the groups of conductors so that the intermediate portions thereof are aligned with said holding and positioning means, moving the conductors normally of their axes towards the housing so that the intermediate portions of the conductors cooperate with said holding and positioning means, bending first end portions of said conductors to form the contact portions, and bending second end portions of said conductors to form the lead portions.

Sometimes, to achieve greater modularity, it is preferred to produce a two-piece modular phone jack assembly. An example of such an assembly employing flat stamped metallic contacts is disclosed in U.S. Pat. No. 4,327,958. Other examples of two-piece designs are disclosed in U.S. Pat. Nos. 4,202,593 and 4,274,691.

Typically, two-piece modular phone jack assemblies include a connector housing having a forward end with the plug receiving opening formed therein, two opposed sidewalls, the internal surfaces thereof defining said socket side surfaces, a top wall joining said sidewalls and a rearward end with a rear opening formed therein. A carrier subassembly is mounted through the rear opening of the housing. The subassembly has a dielectric support member to which the conductors are mounted. Means are provided which cooperate between the housing and subassembly to lock the subassembly to the housing.

Although two-piece assemblies offer some advantages regarding mechanical strength and integrity, it has always been assumed that it is more expensive to manufacture and assemble a two-piece jack assembly as compared with a one-piece jack. This is mainly due to the fact that it is heretofore not been known how to automate such a manufacturing process.

SUMMARY OF THE INVENTION

It is, therefore, a principal object of the present invention to provide an improved low cost two-piece modular phone jack assembly of the type described above which is easier to manufacture and assemble. The improvement resides in said support member which comprises:

a body portion adjacent said housing sidewalls and top wall and including a forwardly facing surface defining the back surface of the socket, a base portion having means for receiving and holding the conductor lead portions, and a conductor mounting portion joining and extending forwardly of said body portion having means formed thereon for positioning and holding the intermediate portions of the conductors which extend generally along the length thereof.

Another principal object of the present invention is to provide a new and improved method of manufacturing and assembling the modular phone jack assembly described herein. The improvement in the method comprises:

producing said support member so that it includes a body portion having a forwardly facing surface defining the back surface of the socket, a base portion having means for receiving and holding the conductor lead portions and a conductor mounting portion joining and extending forwardly of said body portion and having a forward edge and rearward edge; and bending the first end portions and second end portions of the conductors simultaneously against the forward and rearward edges to form the contact portions and end portions respectively.

BRIEF DESCRIPTION OF THE DRAWINGS

FIG. 3 is an exploded perspective view of the modular phone jack assembly of the present invention taken from the rear thereof;

FIG. 4 is a plan view of a group of metal conductors used in association with the modular phone jack assembly of the present invention shown attached at both ends to a carrier strip;

FIG. 5 is a top plan view of a support member comprising a part of the modular phone jack assembly of the present invention;

FIG. 6 is a side view of the support member comprising a part of the modular phone jack assembly of the present invention showing the groups of conductors illustrated in FIG. 4 initially mounted at the top thereof;

FIG. 7 is a side view of the support member used in the modular phone jack assembly of the present invention mounted in a manufacturing tool illustrating a first step in the manufacturing process;

DESCRIPTION OF THE PREFERRED EMBODIMENT

Figure 1:
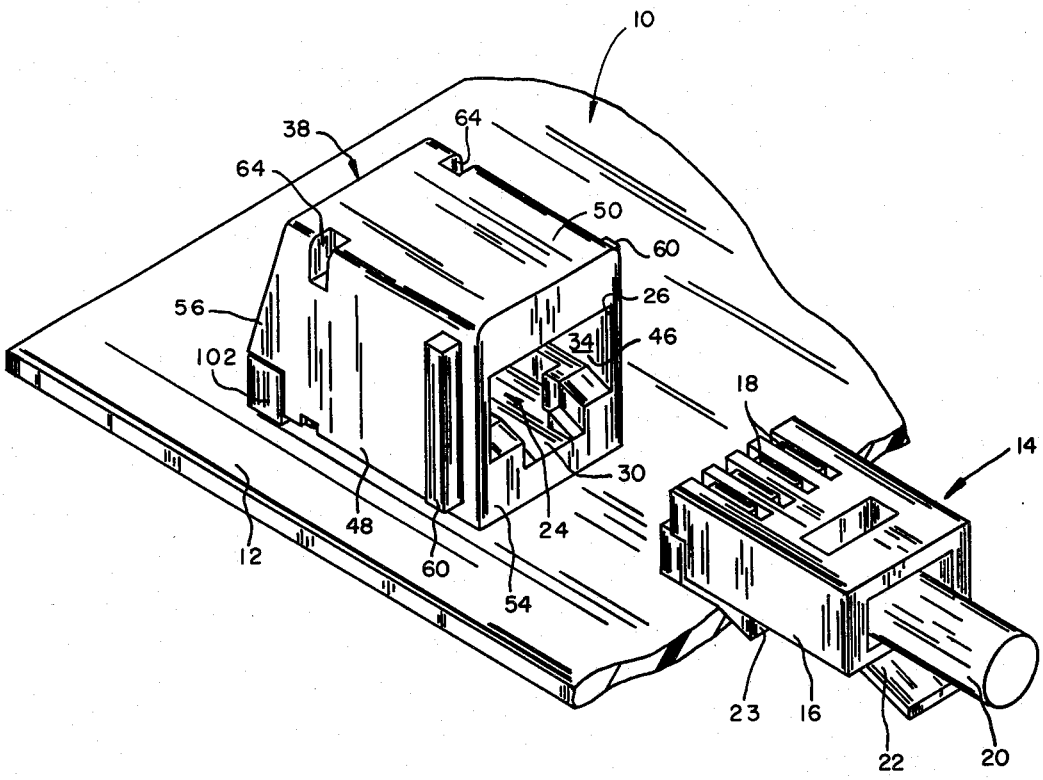
FIG. 1 is a perspective view of the modular phone jack assembly of the present invention mounted on a printed circuit board with a modular plug positioned prior to mating.

Turning now to the drawings, FIG. 1 shows the phone jack assembly of the present invention, generally designated 10, mounted on a printed circuit board 12. The jack assembly 10 is adapted to receive and mate with a standard modular phone plug, generally designated 14.

The plug 14 is seen to generally include a housing 16 having a plurality of termnals 18 therein. The terminals 18 are adapted to electrically contact the jack assembly 10 at one end thereof and the conductors (not shown) of the plug cord 20 at the other end. A manually manipulateable flexible latch 22 is formed on the plug housing 16 to lock and remove the plug 14 from the jack assembly 10.

The jack assembly 10 is of typical dimensions in order to comply with FCC regulation 68.5. As such, the jack assembly 10 has a plug-receiving socket, generally designated 24, formed and defined by a plug-receiving opening 26, opposed top and bottom surfaces, 28 and 30 respectively, which are joined by opposed side surfaces 32 and 34 which extend from said opening 26 to join a back surface 36.

The jack assembly 10 of the present invention generally includes a connector housing, generally designated 38 which mounts a carrier subassembly, generally designated 40. The carrier subassembly 40 includes a dielectric support member, generally designated 42, which mounts a plurality of stamped, metallic, elongated conductors, generally designated 44.

Figure 2:
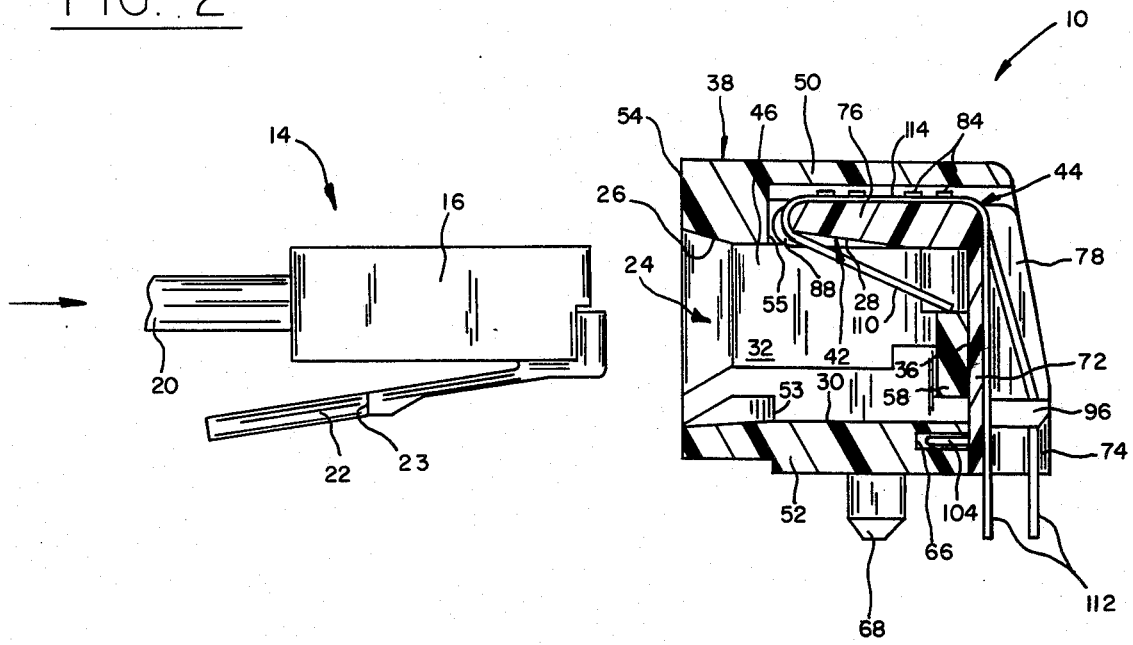
FIG. 2 is a side sectional view of the modular phone jack assembly of the present invention.

Looking at FIGS. 1-3, the housing 38 includes a forward end with the plug receiving opening 26 formed therein. Surrounding opening 26 are two opposed sidewalls 46 and 48 wherein the internal surfaces thereof define the socket side surfaces 32 and 34, respectively, and a top wall 50 and an opposed bottom wall 52.

The front end of the housing 26 has a front mounting face 54 surrounding the plug opening 26. The mounting face 54 has a rearwardly facing surface 55 depending from top wall 50.

As best seen in FIG. 3, a three sided rear shrouded portion 56 extends from the top wall 50 and two side walls 46 and 48 to define the rear opening through which the carrier subassembly 40 is received to be mounted to the housing 38. Formed immediately forward of the shrouded portion 56 is a comb structure 58 which is adapted to cooperate with the conductors 44 in a manner which will be described in greater detail hereinafter.

As is best seen in FIGS. 1 and 3, the housing 38 has a pair of vertical locating ribs 60, one formed on each sidewall 46 and 48. The ribs 60 are adapted to engage a surface of a panel immediately adjacent an opening through which the jack assembly 10 is received (not shown) to provide a flush mount with the face of 54 of housing 38.

Looking at FIG. 3, guide channels 62 are formed on the interior of the shrouded portion 56 of sidewalls 46 and 48. The guide channels 62 extend forwardly to an opening 64 on each sidewall 46 and 48 which serve to interengage with a portion of the carrier subassembly 40 in a manner which will be described in greater detail hereinafter.

Housing 38 has a slot 66 formed in bottom wall 52 as is seen in FIG. 3. As with opening 64, slot 66 is adapted to interengage with a portion of the carrier subassembly 40 in a manner which will be discussed in greater detail hereinafter.

A pair of depending mounting pegs 68 are formed on the bottom wall 52 of housing 38. Pegs 68 are adapted to be received in suitable apertures (not shown) formed in the printed circuit board 12 in a well known manner to secure the jack assembly 10 thereto.

Turning now to the carrier subassembly 40 and, in particular, the support member 42 in greater detail, the support member 42 is seen to generally comprise a vertical body portion 72 having a rearwardly extending horizontal base portion 74 and a forwardly extending cantilevered top conductor mounting portion 76. The forwardly facing surface of body portion 72 defines the aforementioned back surface 36. The body portion 72 also has a pair of side panel portions 78.

The top portion 76 of support member 42 has an upper surface 82 with a plurality of upstanding, staggered locating projections or pins 84. The front end of the top portion 76 has a front edge 86 with a plurality of conductor locating fins 88 formed thereat. The conductors 44 are mounted on the upper surface 82 of the top portion 76 so that a portion thereof extends from the front edge 86 to a rear edge 90.

A pair of side locking wings 92 are provided on the top portion 76. Locking wings 92 are receivable within guide channels 62 and interengage into openings 64 when the carrier subassembly 40 is mounted to the housing 38.

The base portion 74 has a rearwardly extending staggered contact receiving structure 96 with restricted contact receiving slots 98 formed therein. Each slot 98 has a tapered guide or throat portion 100 formed rearwardly thereof in order to guide a portion of a conductor 44 therein as is best shown in FIG. 5.

Extending laterally of the base portion 74 are a pair of standoff block portions 102. Block portions 102 underlie the shrouded portion 56 and comprise an extension of sidewalls 46 and 48 when the carrier subassembly 40 is mounted within the housing 38.

To further secure the carrier subassembly 40 into the housing 38, a pair of resilient tabs 104 extend forwardly of the base portion 74. Tabs 104 are adapted to be received within slot 66 in the housing and have hooked portions that engage shoulders (not shown) therein when the carrier subassembly 40 is mounted to the housing 38.

Looking at FIG. 3, each conductor is seen to generally include a contact portion 110, a lead portion 112 and an intermediate portion 114 therebetween. The intermediate portion 114 of each conductor 44 has a pair of spaced apart pilot holes 116 formed therein. The pilot holes 116 of adjacent conductors 44 are staggered with respect to one another (FIG. 4). Locating projections 84 are adapted to be received within pilot holes 116 so as to position the conductor 44 on the support member 42.

Each conductor 44 also includes a stop shoulder 118 formed on the lead portion 112 thereof. The stop shoulder 118 engages the bottom of the contact receiving structure 96 so as to prevent accidental removal of the lead portions 112 due to an upwardly directed pushout force.

When the carrier subassembly 40 is mounted within the housing 38, and held in that position by virtue of the interengagement of locking wings 92 with openings 64 and tabs 104 within slots 66, contact portions 110 of the conductors 44 are positioned and held apart by the comb structure 58. When fully assembled, the jack assembly 10 meets all the required specifications and has all the necessary dimensions to receive a standard modular phone plug 14.

In the past, it was widely accepted that the only reason to have a two-piece jack assembly was to achieve modularity. It was assumed that the manufacturing process and, in particular, the assembly procedure would be more complicated, and, therefore, more costly than a one-piece design.

As with a one-piece design, the conductors 44 are provided in a typical flat stamped metallic strip (not shown) consisting of a plurality of groups 124 of conductors (FIG. 4). Each group 124 of conductors 44 are stamped so that there are a pair of carrier strips 126, one at each thereof.

The first step is to position a group 124 of conductors on the upper surface 82 of the top portion 76 of support member 42. The conductors 44 are accurately positioned by means of the upstanding projections 84 being received in the corresponding locating or pilot holes 116.

The next step, as best shown in FIG. 7, requires that the support member 42 and the positioned group 124 of conductors 44 are held or received within a suitable tool nest 128. The group 124 of conductors lie on top of an anvil 130 which faces a cutoff punch 132. When the punch 132 is actuated downwardly, the carrier strips 126 are removed while, simultaneously, the tops of the projections 84 are deformed or staked. After deformation, the cross-sectional area of the tops of projections 84 is larger than the pilot holes 116. In this manner, the intermediate portions 114 of conductors 44 are accurately and permanently positioned and secured to the support member. It is because of this positive positioning that the succeeding steps of the method of production can be produced with a great deal of economy and efficiency.

Figure 8:
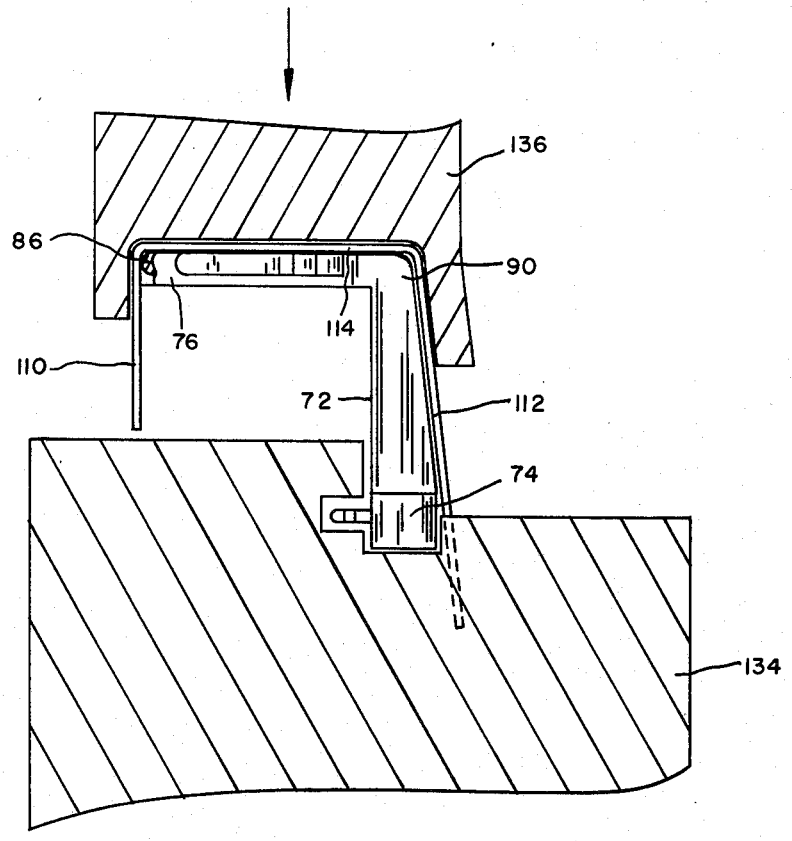
FIG. 8 is a view similar to FIG. 7 showing a succeeding step in the manufacturing process.

Turning now to FIG. 8, the support member 42 which has the conductors 44 secured thereto, is positioned within a holding fixture 134. A top forming die 136 is downwardly moveable so that the conductors 44 are formed to produce the bends which divide the intermediate portion 114 from the contact portion 110 and lead portion 112. The contact portion 110 is bent about the front edge 86 of the top portion 76 while the lead portion 112 is formed about the rear edge 90. The downward bending of both the contact portions 110 and lead portions 112 of all of the conductors 44 occurs simultaneously unlike in the prior art.

Figure 9:
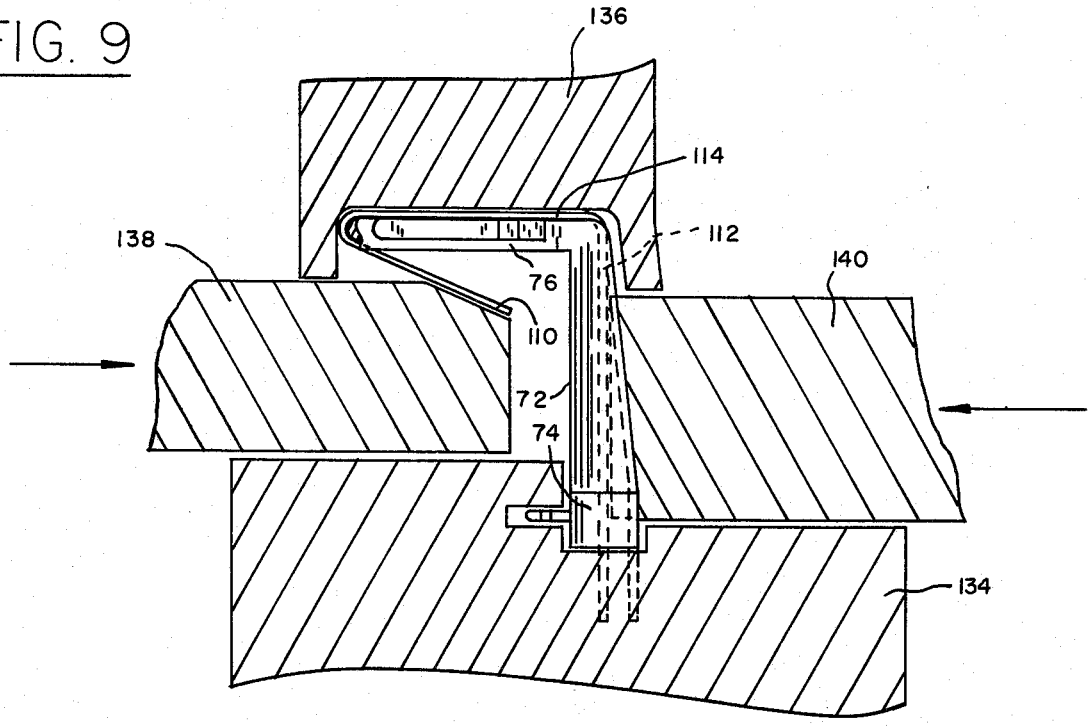
FIG. 9 is another view similar to FIGS. 7 and 8 illustrating still another succeeding step in the manufacturing process.

After the contact portions 110 and lead portions 112 are initially formed, a second forming operation is performed as is shown in FIG. 9. The top forming die 136 is raised somewhat to allow for adequate clearance for a front forming die 138 and a rear forming die 140. Both forming dies 138 and 140 are moved simultaneously toward the support member 42 so that the contact portions 110 of the conductors 44 are angled rearwardly to their final position and the lead portions 112 are staggered and pushed into their respective contact receiving slots 98.

At the completion of the operation shown in FIG. 9, a finished carrier subassembly 40 is produced. The carrier subassembly 40 is then mounted into the housing 38 in the manner described above.

Because of the accurate and firm positioning of the conductors 44 on the support member 42, many of the manufacturing operations can be performed simultaneously. Previously, many of these operations had to be performed one-at-a-time. Because of the efficiencies enjoyed by the structure of the jack assembly 10, the cost disadvantages of a two-piece assembly disappear. In addition to the manufacturing economies, a vastly superior structure from a mechanical strength point-of-view is produced. The usual concerns regarding the retention of flat conductors to a one-piece housing are eliminated.

It is also to be understood that even though a printed circuit board mounted jack assembly has been disclosed herein, the present invention could be used for other types of jack assemblies. For example, instead of a printed circuit board, the lead portions of the conductors may be electrically connected to a wire either by crimping or insulation displacement.

I claim:

1. A two-piece modular phone jack assembly of the type having a plug-receiving socket formed therein defined by a plug-receiving opening, opposed top and bottom surfaces joined by opposed side surfaces extending from said opening to join a back surface, said jack assembly including a connector housing having a forward end with the plugreceiving opening formed therein, two opposed side walls, the internal surfaces thereof defining said socket side surfaces, a top wall joining said side wals, a bottom wall joining said side walls, the internal surface of said bottom wall defining the bottom surface of said socket, and a rearward end with a rear opening formed therein, a carrier subassembly in said housing mounted through said rear opening, said carrier subassembly having a dielectric support member and a plurality of stamped, metallic elongated conductors mounted on said support member, each conductor including a contact portion at one end extending from said forward end diagonally into the socket, a lead portion at the other end, and an intermediate portion between said contact portion and lead portion, and means cooperating between said housing and subassembly to lock said subassembly to the housing, the improvement in said carrier subassembly comprising:

a body portion adjacent said housing sidewalls and top wall and including an internal forwardly facing surface defining the back surface of the socket and an external rearwardly facing surface;

a base portion joining the bottom of the body portion having a contact-receiving structure with a plurality of rearwardly open slots formed therein for receiving and holding the conductor lead portions; and a generally horizontal conductor mounting portion joining and extending forwardly of said body portion having an internal bottom surface defining the top wall of the socket and an upwardly facing conductor supporting surface, said conductor mounting portion having a forward edge against which the contact portions of the conductors are bent into the socket and a rearward edge joined to the top of the body portion against which the lead portions of the conductors are bent toward said base portion, and further having a plurality of means upstanding from said upwardly facing surface between said edges for positioning and holding the intermediate portions of the conductors which extend generally along the length thereof;

whereby a continuously open conductor-receiving pathway is defined between a point within the socket along said upwardly facing conductor supporting surface and said rearwardly facing surface of said body portion and a point within said open slots in said base portion.

2. The jack assembly of claim 1 wherein said cooperating means includes a locking member extending forwardly of said base portion having hook means formed on the end thereof and a recess formed in the bottom wall of said housing to receive said locking member, said recess having a shoulder to interengage with said hook means.

3. A two-piece modular phone jack assembly of the type having a plug-receiving socket formed therein defined by a plug-receiving opening, opposed top and bottom surfaces joined by opposed side surfaces extending from said opening to join a back surface, said jack assembly including a connector housing having a forward end with the plug-receiving opening formed therein, two opposed side walls, the internal surfaces thereof defining said socket side surfaces, a top wall joining said side walls, and a rearward end with a rear opening formed therein, a carrier subassembly in said housing mounted through said rear opening, said carrier subassembly having a dielectric support member and a plurality of stamped, metallic elongated conductors mounted on said support member, each conductor including a contact portion at one end extending from said forward end diagonally into the socket, a lead portion at the other end, and an intermediate portion between said contact portion and lead portion, and means cooperating between said housing and subassembly to lock said subassembly to the housing, the improvement in said carrier subassembly comprising:

a body portion adjacent said housing sidewalls and top wall and including an internal forwardly facing surface defining the back surface of the socket and an external rearwardly facing surface;

a base portion joining the bottom of the body portion having a contact-receiving structure with a plurality or rearwardly open slots formed therein for receiving and holding the conductor lead portions; and a generally horizontal conductor mounting portion joining and extending forwardly of said body portion having an internal bottom surface defining the top wall of the socket and an upwardly facing conductor supporting surface, said conductor mounting portion having a forward edge against which the contact portions of the conductors are bent into the socket and a rearward edge joined to the top of the body portion against which the lead portions of the conductors are bent toward said base portion, and further having a plurality of upstanding locating pins formed on said upwardly facing surface between said edges;

each intermediate conductor portion includes a locating hole to receive a respective locating pin therein for positioning and holding the intermediate portions of the conductors on said upwardly facing surface;

whereby a continuously open conductor-receiving pathway is defined between a point within the socket along said upwardly facing conductor supporting surface and said rearwardly facing surface of said body portion and a point within said open slots in said base portion.

4. The jack assembly of claim 3 wherein the holes and pins of adjacent conductors are staggered with respect to each other.

5. The jack assembly of claim 4 wherein each intermediate portion includes at least two spaced apart locating holes.

6. The jack assembly of claim 3 wherein said holding and positioning means further includes a plurality of fins formed adjacent the forward edge of the conductor mounting portion cooperating with said pins to locate the conductors therebetween.

7. A method of making a modular phone jack assembly of the type having a plug-receiving socket formed therein defined by a plug-receiving opening, opposed top and bottom surfaces joined by opposed side surfaces extending from said opening to join a back surface, said jack assembly including a connector housing having a forward end with the plug-receiving opening formed therein, two opposed side walls the internal surfaces thereof defining said socket side surfaces a top wall joining said side walls, and a rearward end with a rear opening formed therein, and a carrier subassembly in said housing mounted through said rear opening, said carrier subassembly having a dielectric support member including holding and positioning means for receiving conductors, and a plurality of stamped, metallic elongated conductors mounted on said support member, each conductor including a contact portion at one end extending from said forward end diagonally into the socket, a lead portion at the other end, and an intermediate portion between said contact portion and lead portion, and means cooperating between said housing and subassembly to lock said subassembly to the housing, said method including the steps of:

producing said housing as a one-piece molded part, producing said support member as a one-piece molded part, manufacturing said conductors as a continuous flat metal strip having a carrier strip with spaced-apart groups of conductors extending in side-by-side coplanar relationship, each group containing the number of conductors required for one of said jack assemblies, positioning said supporting member adjacent one of the groups of conductors so that the intermediate portions thereof are aligned with said holding and positioning means, moving the group of conductors normally of their axes towards said support member so that said intermediate portions of the conductors cooperate with said holding and positioning means, bending first end portions of said conductors to form the contact portions, and bending second end portions of said conductors to form the lead portions, the improvement in said method comprising:

producing said support member so that it includes a body portion having an forwardly facing surface defining the back surface of the socket, a base portion having means for receiving and holding the conductor lead portions, and a conductor mounting portion joining and extending forwardly of said body portion and having a forward edge and a rearward edge; and bending the first end portions and the second end portions of the conductors simultaneously against the forward and rearward edges to form the contact portions and lead portions, respectively.

8. The method of claim 7 including manufacturing the support member so that said holding and positioning means has a plurality of upstanding locating pins formed on the conductor mounting portion of the support member, and manufacturing the conductors so that each intermediate portion thereof has a locating hole formed therein, said positioning step including moving said group of conductors normally of their axes towards the conductor mounting portion so that the locating pins are received within the locating holes.

9. The method of claim 8 including the step of staking the locating pins against the conductors after the positioning step to firmly secure the conductors to the conductor mounting portion of the support member.

10. The method of claim 9 including the step of severing the carrier strip from the conductors, said severing step occuring simultaneously with said staking step.

11. The method of claim 9 wherein said bending step includes a first conductor forming step simultaneously bending the first and second conductor end portions perpendicular relative to said conductor mounting portion and a second conductor forming step simultaneous moving the first and second conductor end portions towards the body portion whereby the first end portions are angled toward the body portion and said second end portions are secured to said base portion.

12. The method of claim 7 including the step of mounting the carrier subassembly to the housing.

* * * * *